US009780498B2

(12) United States Patent
Venaleck et al.

(10) Patent No.: US 9,780,498 B2
(45) Date of Patent: Oct. 3, 2017

(54) TERMINATION OF ELECTRICAL CABLE, AND METHOD OF MAKING

(71) Applicant: Ohio Associated Enterprises, LLC, Painesville, OH (US)

(72) Inventors: John T. Venaleck, Painesville, OH (US); Larry M. Crofoot, Perry, OH (US)

(73) Assignee: Ohio Associated Enterprises, LLC, Painesville, OH (US)

( * ) Notice: Subject to any disclaimer, the term of this patent is extended or adjusted under 35 U.S.C. 154(b) by 0 days.

(21) Appl. No.: 15/180,118

(22) Filed: Jun. 13, 2016

(65) Prior Publication Data

US 2016/0365676 A1 Dec. 15, 2016

Related U.S. Application Data

(60) Provisional application No. 62/174,074, filed on Jun. 11, 2015.

(51) Int. Cl.
*H01R 13/6593* (2011.01)
*H01R 4/04* (2006.01)
*H01R 9/03* (2006.01)

(52) U.S. Cl.
CPC ..... *H01R 13/6593* (2013.01); *H01R 4/04* (2013.01); *H01R 9/032* (2013.01)

(58) Field of Classification Search
CPC ..... H01R 13/502; H01R 13/5804; H01R 13/6593; H01R 4/04; H01R 9/03
USPC ..... 439/607.41, 452, 607.47, 465
See application file for complete search history.

(56) References Cited

U.S. PATENT DOCUMENTS 6,471,545 B1 * 10/2002 Hosler, Sr. ..... H01R 24/542 439/205
6,530,808 B1 * 3/2003 Hosler, Sr. ..... H01R 9/0518 439/578
7,484,998 B2 * 2/2009 Benham ..... H01R 9/0515 439/289
7,628,647 B2 * 12/2009 Semba ..... H01R 12/598 439/579
7,677,927 B2 * 3/2010 Hermant ..... H01R 13/6474 439/607.46
7,762,847 B2 * 7/2010 Feldman ..... H01R 13/11 439/578

FOREIGN PATENT DOCUMENTS

GB 1409674 A * 10/1975 ..... H01R 4/723

* cited by examiner

*Primary Examiner* — Tulsidas C Patel
*Assistant Examiner* — Travis Chambers
(74) *Attorney, Agent, or Firm* — Renner, Otto, Boisselle & Sklar, LLP

(57) ABSTRACT

A cable termination and method are disclosed that electrically and mechanically terminates a bundled cable that requires a radial space only slightly greater than the cable diameter. An electrically-conductive ferrule is connected to an end of a cable, with a conductive adhesive such as a conductive epoxy injected into the ferrule to mechanically connect the ferrule to the cable end, and to electrically couple the ferrule to a shield of the cable, such as a braided wire shield. The ferrule is received by a connector housing, such as being inserted between a pair of connector housing halves, to retain the ferrule mechanically coupled to the housing, and to electrically couple the ferrule to the housing.

16 Claims, 3 Drawing Sheets

TERMINATION OF ELECTRICAL CABLE, AND METHOD OF MAKING

This application claims priority under 35 USC 119 to Provisional Application 62/174,074, filed Jun. 11, 2015, which is incorporated herein in its entirety.

FIELD OF THE INVENTION

The invention is the field electrical shielding for signal-caring devices, such as electrical cables.

BACKGROUND OF THE INVENTION

In the electrical field of signal carrying cables, bundled cables often have a conductive braided shield over the signal bundle to guard against intrusive electromagnetic radiation. This shield is then protected with an external jacket of pliable dielectric, usually PVC Plastic. When the bundle of cables is terminated to a connector or the like, provision must be made to both mechanically support the whole bundle and to electrically terminate the shield to the conductive shell of the connector.

If the diameter of the cable is large compared to the dimension of the receiving connector, little space is left to accommodate a mechanism to mechanically hold the cable while simultaneously causing electrical continuity with the shield.

SUMMARY OF THE INVENTION

Bundled electrical cable with metal braided shield is stripped to expose the braid. A conductive ferrule with minimal wall thickness is installed over the exposed braid and overlaps the exterior jacket of the cable. Small radial ports in the cylindrical wall of the ferrule communicate with internal annular grooves. Conductive adhesive is injected into these ports and flows via the annular grooves, around the cable, then axially forward aft. When cured, the bond forms a strong mechanical attachment and an electrical continuity to the conductive ferrule.

This bundled cable and bonded ferrule assembly is then forcibly clamped between two conductive connector shells using mechanical means such as rivets or screws. A flange on the ferrule communicates with a tapered groove forming a tight fit. This marriage fixes the ferrule both axially and rotationally, and firmly attaches the bundled cable both mechanically and electrically to the connector shells.

According to an aspect of the invention, a cable connection includes: a cable; a ferrule installed on an end of the cable; and a connector that receives the ferrule and the end of the cable; wherein conductive adhesive electrically and mechanically couples the ferrule to the end of the cable.

By an embodiment according to any other paragraph(s) of this summary, the ferrule has one or more annular grooves for receiving the conductive adhesive.

By an embodiment according to any other paragraph(s) of this summary, the ferrule has multiple annular grooves for receiving the conductive adhesive.

By an embodiment according to any other paragraph(s) of this summary, the ferrule has one or more ports, with the one or more ports in fluid communication with respect of the one or more annular grooves, for injecting the conductive adhesive into the one or more annular grooves, while the ferrule is installed on the end of the cable.

By an embodiment according to any other paragraph(s) of this summary, the ferrule has a cylindrical body, and a flange protruding radially outward from one end of the body.

By an embodiment according to any other paragraph(s) of this summary, the conductive adhesive includes a conductive epoxy.

By an embodiment according to any other paragraph(s) of this summary, the conductive adhesive adheres the ferrule to the end of the cable.

By an embodiment according to any other paragraph(s) of this summary, the cable includes: one or more signal wires; a conductive shield that surrounds the one or more signal wires; and an electrically-insulating jacket that surrounds the conductive shield.

By an embodiment according to any other paragraph(s) of this summary, the shield is a braided shield.

By an embodiment according to any other paragraph(s) of this summary, the jacket is removed at the end of the cable, exposing a portion of the shield.

By an embodiment according to any other paragraph(s) of this summary, the ferrule overlies both an exposed portion of the shield, and a portion of the shield that is covered by the jacket.

By an embodiment according to any other paragraph(s) of this summary, the conductive adhesive electrically couples the ferrule to the shield of the cable.

By an embodiment according to any other paragraph(s) of this summary, the conductive adhesive extends longitudinally in both directions from the one or more annular grooves, between the cable end and the ferrule By an embodiment according to any other paragraph(s) of this summary, the housing has a pair of connector shells or halves that are brought together to enclose part of the ferrule.

By an embodiment according to any other paragraph(s) of this summary, the connector shells or halves are held together by fasteners.

By an embodiment according to any other paragraph(s) of this summary, the connector shells or halves are held together by rivets.

By an embodiment according to any other paragraph(s) of this summary, the connector shells or halves have a groove therein that receive the flange of the ferrule.

By an embodiment according to any other paragraph(s) of this summary, the groove is a tapered groove that facilitates entry of the flange into the groove.

By an embodiment according to any other paragraph(s) of this summary, the engagement of the flange and the groove tightens to interference as the connector shells or halves are brought together.

By an embodiment according to any other paragraph(s) of this summary, the engagement of the flange and the groove fixes the ferrule relative to the housing both axially and rotationally.

By an embodiment according to any other paragraph(s) of this summary, the engagement of the flange and the groove provide electrical contact between the ferrule and the housing.

By an embodiment according to any other paragraph(s) of this summary, the housing is made of an electrically conductive material, such as a suitable metal.

By an embodiment according to any other paragraph(s) of this summary, the connector shells or halves are split along a longitudinal axis of the cable.

According to another aspect of the invention, a cable connection comprising: a cable connected to a connector housing, wherein the connector housing is in two halves split roughly on the axis of the cable; and a conductive ferrule with a flange mates with the two conductive connector halves at a tapered groove in the halves of the housing; wherein the two halves are forcibly held together with rivets or the like; wherein the ferrule has radial ports through which conductive adhesive is injected; and wherein the adhesive bonds to a cable jacket of the cable, and to a metallic braid of the cable, to form a strong joint and an electrical continuity between the conductive connector housings and the cable braid via the conductive ferrule.

According to yet another aspect of the invention, a method of making a cable connection includes the steps of: connecting a ferrule to an end of a cable by use of a conductive adhesive; and coupling the ferrule to a connector housing.

By an embodiment according to any other paragraph(s) of this summary, the cable connection includes the features of any previous paragraph or combination of paragraphs (or parts of paragraphs).

By an embodiment according to any other paragraph(s) of this summary, the connecting includes injecting the conductive adhesive into one or more ports in the ferrule.

By an embodiment according to any other paragraph(s) of this summary, the injecting places the conductive adhesive in one or more annular grooves on an inner surface of the ferrule, between the ferrule and the cable.

By an embodiment according to any other paragraph(s) of this summary, the conductive adhesive in at least one of the annular grooves is in contact with an electrically conductive shield of the cable end.

By an embodiment according to any other paragraph(s) of this summary, the conductive adhesive in at least another of the annular grooves is in contact with an electrical insulator jacket that surrounds the shield.

By an embodiment according to any other paragraph(s) of this summary, the coupling includes mechanically and electrically coupling the ferrule to the housing.

By an embodiment according to any other paragraph(s) of this summary, the coupling includes placing a flange of the ferrule in a groove of connector shells of the connector housing with the ferrule between the connector shells.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

The present invention provides a method to terminate the cable bundle and shield using minimal radial space allowing for the smallest possible connector for the given cable diameter. A conductive adhesive is used to mechanically couple a metal ferrule to a cable end. The conductive adhesive also electrically couples the electrical shield of the cable (e.g., a wire braid) to the ferrule. The ferrule is received by a connector housing, such as being inserted between a pair of connector housing halves, to retain the ferrule mechanically coupled to the housing, and to electrically couple the ferrule to the housing. A cable termination and method are disclosed that electrically and mechanically terminates a bundled cable that requires a radial space only slightly greater than the cable diameter.

Figure 1:
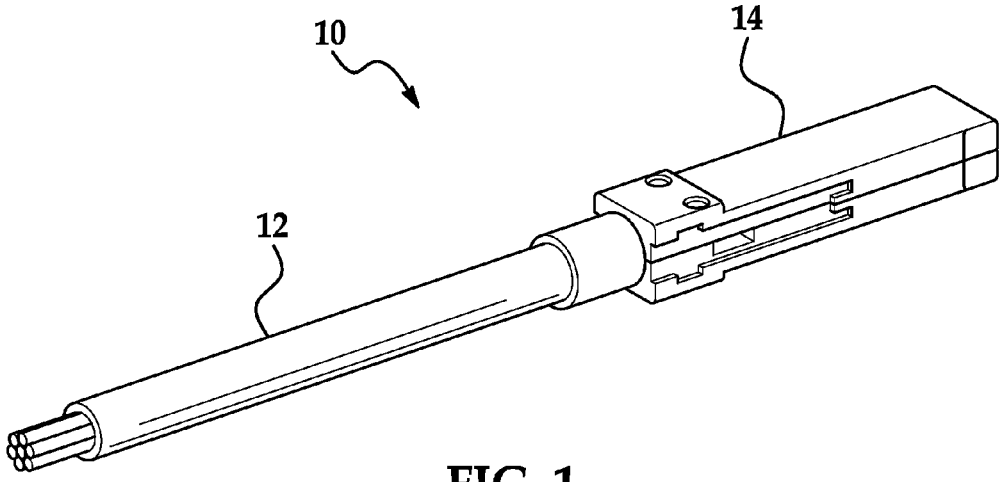
FIG. 1 is an oblique view of an assembled cable and connector, in accordance with an embodiment of the invention.

FIG. 1 shows an assembly 10, an assembled bundled cable 12 and connector 14. The assembly 10 is the finished product of the assembly process described below.

Figure 2:
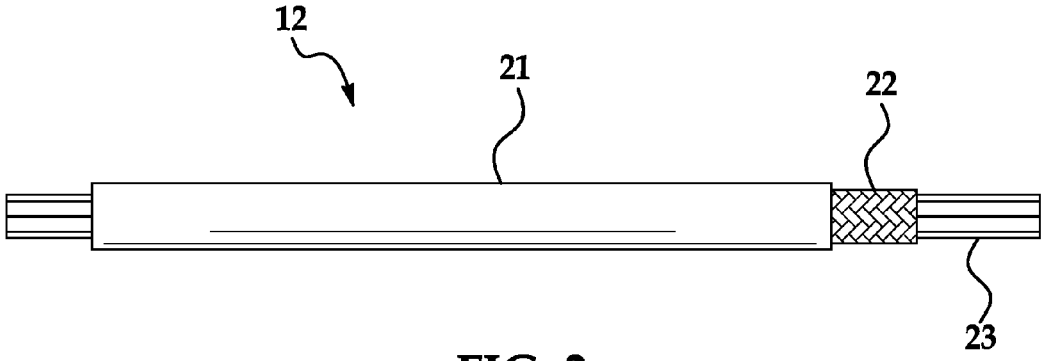
FIG. 2 is a side view of the cable of the combination of FIG. 1.

FIG. 2 details the bundled cable 12. The cable 12 consists of a protective jacket 21, a braided shield 22, and a bundle of signal wires 23. The braided shield 22 is a braid of electrically-conductive small wires that wraps around (surrounds) and electrically isolates the signal wires 23. The protective jacket 21 is made of an electrical insulator, such as plastic, and wraps around the shield 22.

Figure 3:
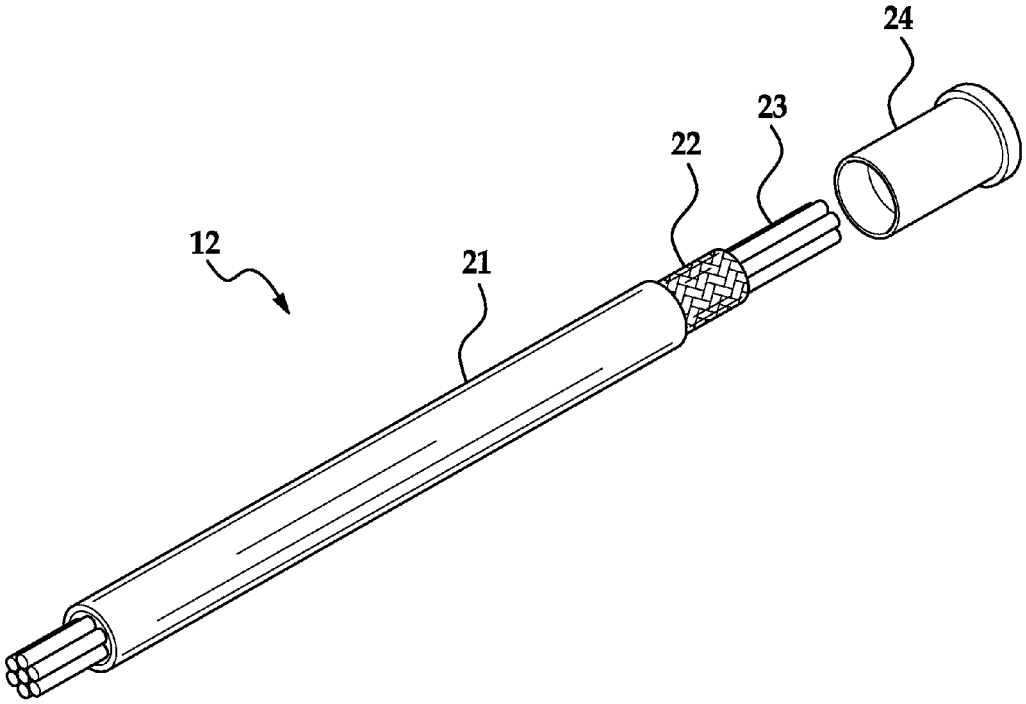
FIG. 3 is an oblique exploded view of the cable of FIG. 2, in combination with a ferrule.

FIG. 3 shows the bundled cable 12 with the jacket 21 stripped on one end, exposing the braided shield 22, preparatory to terminating into a specially prepared ferrule 24 that is made of a conductive material, such as a suitable conductive metal, for instance steel, copper, or a copper alloy. The ferrule 24 on the end of the cable 12 is used to mechanically connect the cable 12 to the connector 14. The ferrule 24 also electrically connects the shield 22 to the connector 14.

Figure 4:
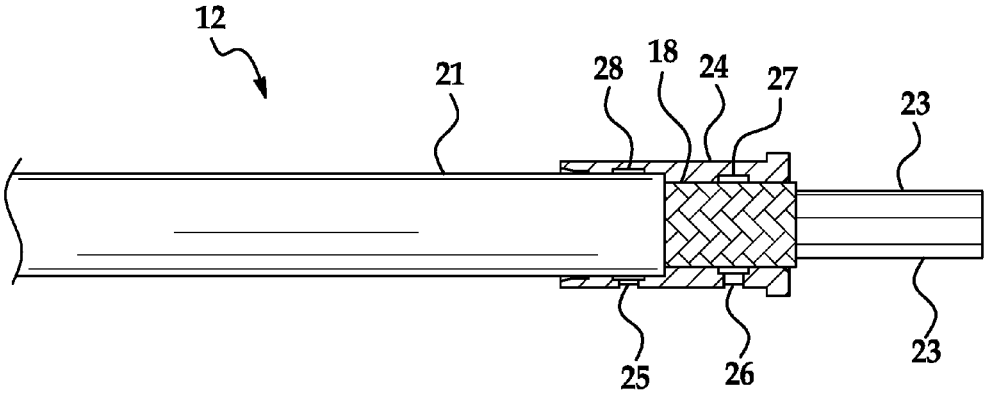
FIG. 4 is a side partial cross-sectional view of the combination of the cable and ferrule of FIG. 3.

FIG. 4 details the several features of the ferrule 24. The prepared end of the cable 12 is inserted into the conductive ferrule 24. Two radial ports 25 and 26 of the ferrule 24 communicate with annular grooves 27 and 28 that are recesses along an inner surface of the ferrule 24.

The two ports 25 and 26 provide ingress for a conductive adhesive 18, such as a conductive epoxy, that is pressure injected. The epoxy (or other adhesive) 18 enters and is distributed cylindrically around two channels 27 and 28 forward and aft. An example of a suitable conductive adhesive is the CircuitWorks brand CW2400-9700 epoxy conductive adhesive. The epoxy (adhesive) 18 then proceeds under pressure in an axial direction both fore and aft. When the adhesive cures, the cable jacket 21 is bonded to the ferrule 24, and the cable braid 22 is bonded to the ferrule 24. Since the epoxy (or other adhesive) 18 is electrically conductive, the braid 22 is now electrically common to the ferrule 24. The process mechanically and electrically couples the cable 12 to the ferrule 24.

Figure 5:
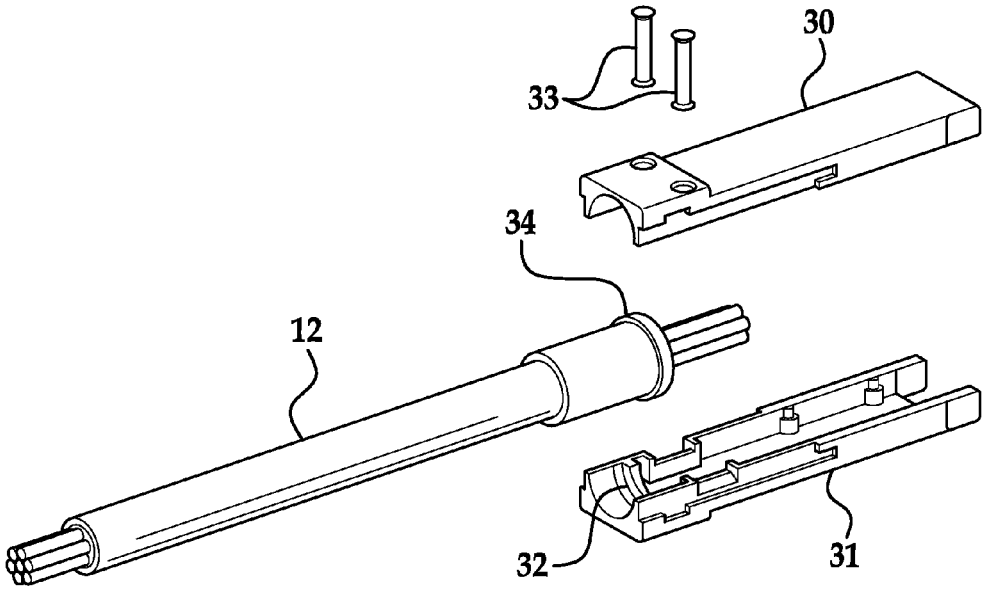
FIG. 5 is an exploded view of the combination of FIG. 1.
Figure 6:
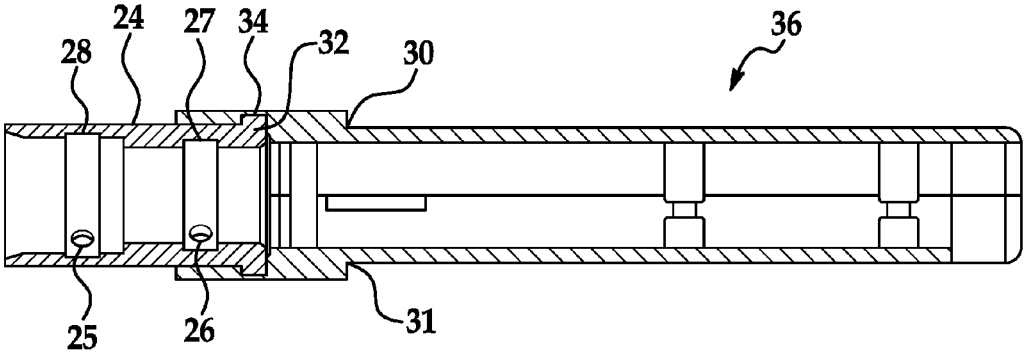
FIG. 6 is a side sectional view of the ferrule and the housing of the assembly of FIG. 1.

FIG. 5 shows the assembled cable/ferrule combination 29, with the ferrule 24 attached to the cable 12, ready to be installed between two conductive connector shells 30 and 31 that together constitute a housing 36 of the connector 14. The conductive connector shells 30 and 31 may be used to connect to a suitable mating connector or mating device, which may have any of a variety of forms. The connector shells 30 and 31 may be made of a suitable electrically-conductive materials, such as a metal, for example the same metal as the ferrule.

A flange 34 on the ferrule protrudes radially to a diameter larger than that of the ferrule body. A tapered groove 32 in the connector housing shells 30 and 31 provides a small interference with the flange 34. The groove 32 is tapered in that it is wider in a longitudinal (axial) direction at its opening, than at its bottom (radially outward end). The taper of the groove 32 allows easy entry of the flange 34 but tightens to interference as the two halves 30 and 31 of the housing 36 are brought together. This interference provides the good electrical contact and fixes the ferrule 24 and the cable 12 both axially and rotationally in the connector housing. After the housing halves are forcibly brought together, the two halves are riveted, using rivets 33 to maintain the assembly. Other fasteners, such as screws or bolts, may be used as an alternative to the rivets 33.

The illustrated embodiment is only one specific embodiment of the present invention. Many variations are possible. For example, the cable may have a shield that is other than braided wires, and/or may have a different shape that the one shown. The ferrule may have a different configuration, for example a different number and/or arrangement of ports and grooves for spreading that the conductive adhesive, than what is shown. The connector may have any of a wide variety of different configurations, for receiving the ferrule and for engaging other connectors or other devices.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A cable connection comprising:

a cable;

a ferrule installed on an end of the cable; and a connector that receives the ferrule and the end of the cable;

wherein conductive adhesive electrically and mechanically couples the ferrule to the end of the cable; and wherein the conductive adhesive bonds to a cable jacket of the cable, and to a metallic braid of the cable, to form an electrical continuity between the connector and the metallic braid, via the conductive ferrule.

2. The cable connection of claim 1, wherein the conductive adhesive includes a conductive epoxy.

3. The cable connection of claim 1, wherein the housing has a pair of connector shells that are brought together to enclose part of the ferrule.

4. The cable connection of claim 1, wherein the ferrule has one or more annular grooves for receiving the conductive adhesive.

5. The cable connection of claim 4, wherein the ferrule has multiple annular grooves for receiving the conductive adhesive.

6. The cable connection of claim 4, wherein the ferrule has one or more ports, with the one or more ports in fluid communication with respect of the one or more annular grooves, for injecting the conductive adhesive into the one or more annular grooves, while the ferrule is installed on the end of the cable.

7. The cable connection of claim 1, wherein the ferrule has a cylindrical body, and a flange protruding radially outward from one end of the body;

wherein the housing has a pair of connector shells that are brought together to enclose part of the ferrule; and wherein the connector shells have a groove therein that receives the flange of the ferrule.

8. The cable connection of claim 7, wherein the groove is a tapered groove that facilitates entry of the flange into the groove; and wherein the engagement of the flange and the groove tightens to interference as the connector shells or halves are brought together.

9. The cable connection of claim 1, wherein the cable includes one or more signal wires that are surrounded by the cable jacket and the metallic braid.

10. The cable connection of claim 9, wherein the ferrule overlies both an exposed portion of the metallic braid, and a portion of the metallic braid that is covered by the jacket.

11. A cable connection comprising:

a cable connected to a connector housing, wherein the connector housing is in two halves split roughly on the axis of the cable; and a conductive ferrule with a flange mates with the two conductive connector halves at a tapered groove in the halves of the housing;

wherein the two halves are forcibly held together with rivets or the like;

wherein the ferrule has radial ports through which conductive adhesive is injected; and wherein the adhesive bonds to a cable jacket of the cable, and to a metallic braid of the cable, to form a strong joint and an electrical continuity between the conductive connector housings and the cable braid via the conductive ferrule.

12. A method of making a cable connection, the method comprising:

connecting a ferrule to an end of a cable by use of a conductive adhesive; and coupling the ferrule to a connector housing;

wherein the conductive adhesive in at least one of the annular grooves is in contact with an electrically conductive shield of the cable; and wherein the conductive adhesive in at least another of the annular grooves is in contact with an electrical insulator jacket that surrounds the shield.

13. The method of claim 12, wherein the connecting includes injecting the conductive adhesive into one or more ports in the ferrule.

14. The method of claim 13, wherein the injecting places the conductive adhesive in one or more annular grooves on an inner surface of the ferrule, between the ferrule and the cable.

15. The method of claim 12, wherein the coupling includes mechanically and electrically coupling the ferrule to the housing.

16. The method of claim 12, wherein the coupling includes placing a flange of the ferrule in a groove of connector shells of the connector housing, with the ferrule between the connector shells.

* * * * *